US005107769A

United States Patent [19]

Sjöström

[11] Patent Number: 5,107,769

[45] Date of Patent: Apr. 28, 1992

[54] GRIP

[75] Inventor: Harry Sjöström, Frösön, Sweden

[73] Assignee: Liftbyggarna AB, Östersund, Sweden

[21] Appl. No.: 671,788

[22] PCT Filed: Sep. 15, 1989

[86] PCT No.: PCT/SE89/00497

§ 371 Date: Mar. 25, 1991

§ 102(e) Date: Mar. 25, 1991

[87] PCT Pub. No.: WO90/03294

PCT Pub. Date: Apr. 5, 1990

[30] Foreign Application Priority Data

Sep. 28, 1988 [SE] Sweden ..... 8803432-7

[51] Int. Cl.[5] ..... B61B 12/12

[52] U.S. Cl. ..... 104/209; 104/218

[58] Field of Search ..... 104/200, 202, 204, 207, 104/208, 209, 218, 223; 24/115 G, 135 L, 135 N, 136 R

[56] References Cited

U.S. PATENT DOCUMENTS

| | | | |
|---|---|---|---|
| 738,306 | 9/1903 | Finlayson | 104/200 X |
| 2,616,646 | 11/1952 | Matthysse | 24/115 G |
| 3,420,189 | 1/1969 | Wallmannsberger | 104/202 |
| 3,605,491 | 9/1971 | Senn | 104/209 X |
| 4,573,414 | 3/1986 | Cantin et al. | 104/202 |

FOREIGN PATENT DOCUMENTS

| | | | |
|---|---|---|---|
| 1376056 | 9/1964 | France | 104/202 |

*Primary Examiner*—Robert J. Oberleitner
*Assistant Examiner*—Kevin D. Rutherford
*Attorney, Agent, or Firm*—McFadden, Fincham, Marcus & Anissimoff

[57] ABSTRACT

A grip comprises a body (1) with an abutment and a suitably spring-loaded clamping jaw (3) which is movable relative to the body and which serves to clamp a rope (4) against the abutment so as to fix the grip in the desired position along the rope. The abutment consists of two thin clips or bands (7,7') which in their mounted state are spaced apart and are separately applicable to the rope (4) and subsequently connectible with the body on each side of the clamping jaw (3), while completely surrounding the rope.

2 Claims, 2 Drawing Sheets

GRIP

TECHNICAL FIELD OF THE INVENTION

The present invention relates to a grip comprising a body with an abutment and a suitably spring-loaded clamping jaw which is movable relative to the body and which serves to clamp a rope against the abutment so as to fix said grip in the desired position along the rope.

BACKGROUND OF THE INVENTION

In prior art grips of the type described above, the abutment consists of a hook member of substantially crescent-shaped cross-section, whose two opposite ends are integrally formed with two separate arms which are, in turn, integrally formed with the body proper and between which the clamping jaw is positioned to press the rope against the concave inner side of the hook member. On application of the grip to the rope, the clamping jaw is moved back to an end position which is maximally spaced from the hook member and in which the distance between the clamping jaw and the hook member is slightly greater than the diameter of the rope, such that the grip can be laterally hooked on to the rope, whereupon a concavely formed front surface of the clamping jaw is pressed against the rope, for example by means of a spring in the body, thereby clamping the rope in the nip between said front surface and the concave inner side of the hook member. To be reliable, this grip must be provided with an amply dimensioned hook member serving as an abutment. In practice, the hook member thus is of a thickness which is considerably greater than half the rope diameter. However, this results in the hook member projecting from the rope to a disproportionately great extent so that it strikes against different types of guide wheels included in, for example, ski-lifts and similar ropeways, whereby the guide wheels regularly cause inconvenient rattling noises, in addition to being subjected to wear themselves.

BRIEF DESCRIPTION OF THE INVENTIVE IDEA

The present invention aims at eliminating the above-mentioned drawbacks of prior art grips and at providing a grip which operates silently when driving a ropeway, for example a ski-lift, without the demands for reliability being neglected. According to the invention, this is achieved in that the abutment consists of two thin bands of metal which in their mounted state are spaced apart and are separately applicable to the rope, each of said bands having two opposite end portions which are conjointly inserted in a slit formed in the body and which are secured in said slit by a locking means, the two bands being positioned each on one side of the clamping jaw which is movable relative to said body, and at the same time completely surrounding the rope.

Since the two bands, in contrast to the hook member in prior art grips, which is open in one direction, completely surround the rope, they can be made of a comparatively very thin material, without the capability of the bands of resisting the compressive force of the clamping jaw being lost. For comparison, it may be mentioned that when tested, steel bands having a thickness of 1.0–1.5 mm appeared to yield a strength which is even higher than the corresponding strength of a hook member of about 8 mm thickness.

FURTHER DESCRIPTION OF PRIOR ART

U.S. Pat. No. 660,395 discloses a grip which per se comprises two band-shaped members which are spaced apart and partly surround the rope. In this grip—which has no kind of movable clamping jaw whatsoever—the individual band member is, however, clamped against the rope by means of a pair of nuts which are screwed to threaded, specially designed end portions of the band member and are tightened against the actual body of the grip. However, such clamping nuts can readily, even after a short period of use in the difficult surroundings of a ski-lift, inadvert-loosen from their tightened state, and this can be disastrous in particular ski-lifts. In contrast hereto, the inventive grip provides an absolutely reliable connection with the rope for a long time, in that the suitably spring-loaded clamping jaw which is disposed between the two bands, never runs the risk of coming loose from its rope-clamping state.

BRIEF DESCRIPTION OF THE ACCOMPANYING DRAWING

DETAILED DESCRIPTION OF A PREFERRED EMBODIMENT OF THE INVENTION

Figure 2:
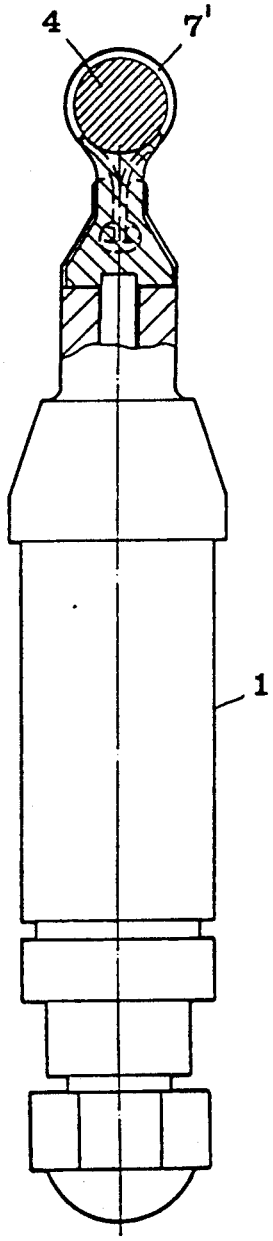
FIG. 2 is a similar view as seen at an angle of 90° relative to the view in FIG. 1.
Figure 1:
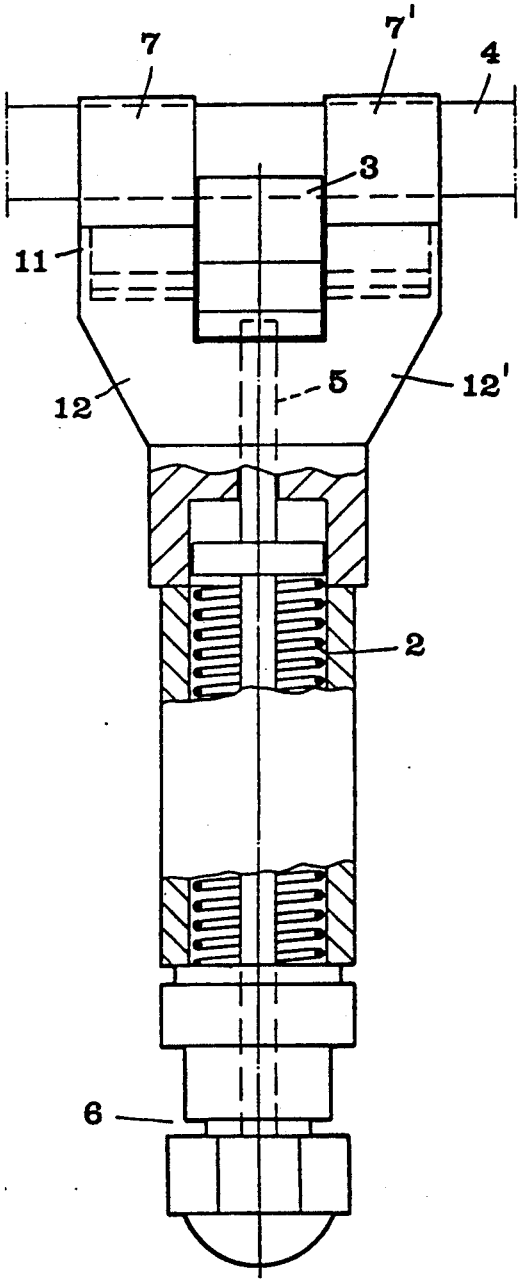
FIG. 1 is a partly sectional view of the inventive grip.
Figure 3:
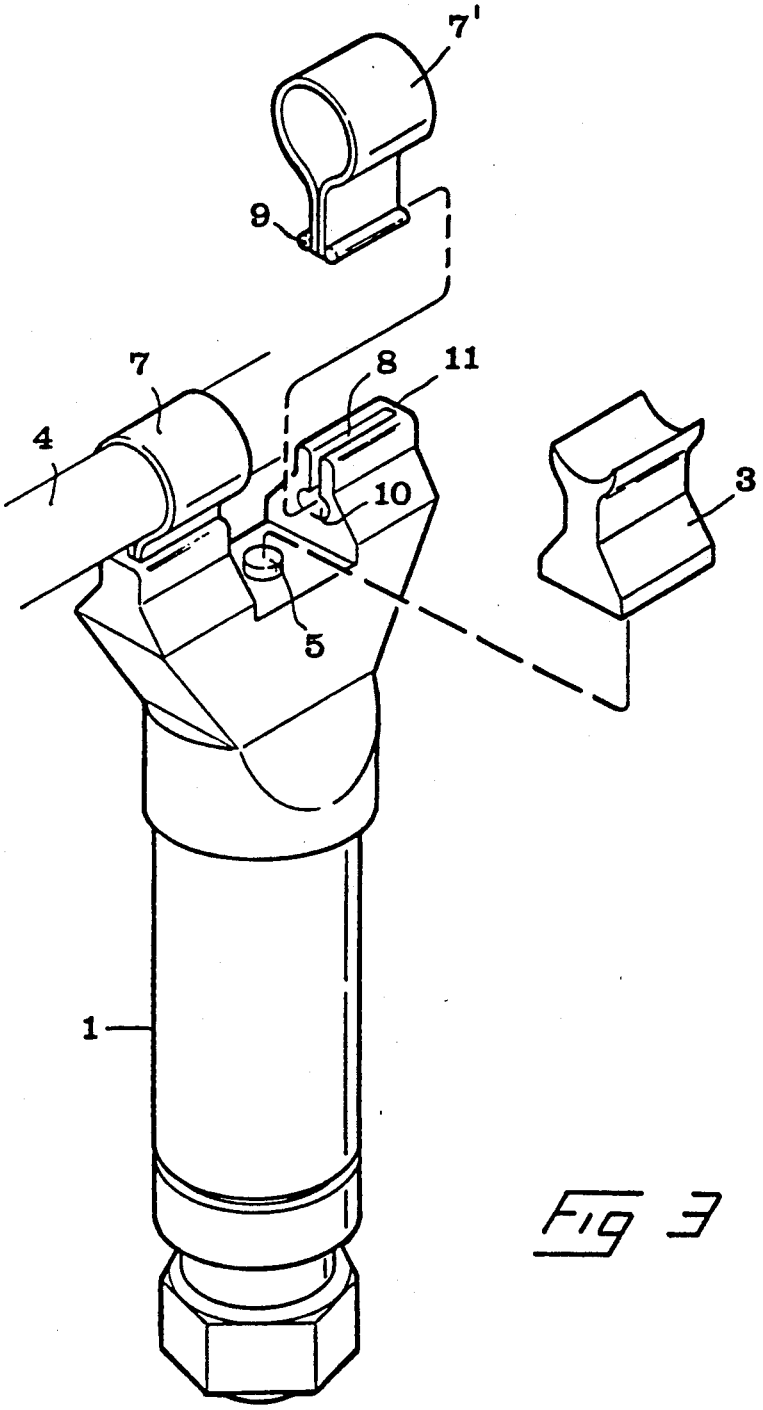
FIG. 3 is an exploded view of the same grip, during mounting on a rope.

The grip illustrated in the drawing comprises in per se known manner a body which in its entirety is designated 1 and in which at least one spring 2 is arranged for pressing a clamping jaw 3 against a rope or wire designated 4. The clamping jaw 3 is detachably mounted at the free end of a shaft 5 which is actuated by the spring 2 in such manner that the clamping jaw normally is kept resiliently pressed against the rope. To remove the grip from the rope 4, the shaft Can be withdrawn to a rear end position by compression of the spring 2 by means of a screw mechanism 6. Optional components, such as tow rods of a ski-tow or the like, may be connected to the grip in some suitable manner.

According to the invention, two thin clips or bands 7,7' are arranged as abutments, which are separately applicable to the rope 4 and subsequently connectible with the body 1 on each side of the clamping jaw 3, while completely surrounding the rope. More precisely, the two bands 7,7' are preformed such that the main portion thereof constitutes a cylindrical configuration of substantially the same diameter as the rope 4. The two opposite end portions of each individual band are conjointly inserted in a slit 8 formed in the body and are secured therein by suitable locking means. In the embodiment illustrated, the locking means consist of beads or projections 9, e.g. metal rods that are welded to the ends of the bands. The beads are accommodated in a cavity 10 which is formed in the body at a distance from the opening of the slit S. In this embodiment, both the slit 8 and the cavity 10 are closed on one side by means of an outer end wall 11 ensuring that the band cannot slip out of the slit in the direction away from the body.

The grip is mounted on the rope 4 in the following manner. The clamping jaw 3 is removed from the space between the two separate legs 12,12' of the body 1, and the two bands 7,7' are applied to the rope by snap action. Then, first one band is inserted in the space between the legs 12,12' and its ends are moved laterally into one of the two slits, whereupon the other band is positioned in the space between the legs 12,12' and its ends are moved into the other slit. Subsequently, the clamping jaw 3 is reinserted in the space between the legs 12,12', while the spring 2 is still kept in its compressed state by the screw mechanism 6. After that, the screw mechanism 6 is caused to release the spring 2 to act on the clamping jaw 3 which, in turn, presses the rope 4 against the halves of the annular bands 7,7', which are spaced from the body, while the rope is clamped and the grip is fixed in the desired position along the rope.

FEASIBLE MODIFICATIONS OF THE INVENTION

Of course, the invention is not limited to the embodiment described above and shown in the drawing. Thus, instead of the beads 9 as shown, other locking means can be used for securing the individual abutment bands to the body of the grip. As locking means, use can be made of e.g. screws or screws combined with clamping jaws which clamp the ends of the band against parts of the body. Moreover, the illustrated end walls 11 adjacent to the slits may be dispensed with, so as to render it possible to insert the ends of the bands into the slits from outside, instead of from inside. In this case, the ends of the bands can be secured in the slits by other means, such as locking pins, screws or the like.

I claim:

1. A grip comprising a body having abutment means; movable clamping means; said body having a cavity and slit therein with said slit being in communication with said cavity; said clamping means comprising a spring loaded clamping jaw having a pair of sides, said clamping jaw being movable relative to said body for clamping a rope relative to said body and for fixing said grip in a desired position along a rope; said abutment means comprising a pair of thin metal bands, said bands being positioned one at each side of said clamping jaw, said metal bands being spaced apart and adapted to each separately engage and surround a rope; each of said bands having a pair of opposite end portions conjointly insertable in said slit, said end portions having locking means in the form of projections, said projections being insertable and securable in said cavity.

2. The grip as claimed in claim 1, wherein said projections are metal rods affixed to said end portions.

* * * * *